US007118486B2

(12) United States Patent
Evers

(10) Patent No.: US 7,118,486 B2
(45) Date of Patent: Oct. 10, 2006

(54) LASER LIGHT AIMING TRAINER FOR THE GAME OF POOL AND SIMILAR GAMES

(76) Inventor: Edward E. Evers, 16352 Del Norte Dr., Victorville, CA (US) 92392

( * ) Notice: Subject to any disclaimer, the term of this patent is extended or adjusted under 35 U.S.C. 154(b) by 0 days.

(21) Appl. No.: 10/968,263

(22) Filed: Oct. 19, 2004

(65) Prior Publication Data

US 2005/0037851 A1 Feb. 17, 2005

Related U.S. Application Data

(60) Provisional application No. 60/569,542, filed on May 10, 2004.

(51) Int. Cl.
*A63D 15/00* (2006.01)

(52) U.S. Cl. ..... 473/2

(58) Field of Classification Search ..... 473/2, 473/1, 5, 17, 44, 52, 219, 220, 40; 33/286
See application file for complete search history.

(56) References Cited

U.S. PATENT DOCUMENTS

| | | | | |
|---|---|---|---|---|
| 3,466,038 | A | 9/1969 | Hill | |
| 4,183,523 | A | 1/1980 | Hecht | |
| 4,688,796 | A | 8/1987 | Wright | |
| 4,882,676 | A | 11/1989 | Van De Kop et al. | |
| 5,275,398 | A | 1/1994 | Compton | |
| 5,554,075 | A | 9/1996 | Glazer | |
| 5,738,595 | A * | 4/1998 | Carney | 473/209 |
| 6,117,019 | A | 9/2000 | Taylor | |
| 6,155,929 | A | 12/2000 | Chipman | |
| 6,609,307 | B1 | 8/2003 | Haynes et al. | |
| 6,629,897 | B1 * | 10/2003 | Belknap | 473/40 |
| 6,769,992 | B1 * | 8/2004 | Domulevicz et al. | 473/2 |
| 6,827,651 | B1 * | 12/2004 | Davis | 473/2 |
| 2003/0059752 | A1 | 3/2003 | Gratinski et al. | |
| 2005/0209013 | A1 | 9/2005 | Davis et al. | |

OTHER PUBLICATIONS

Advertisement from Internet entitled "The Spider," How The Spider Works—Improve Your Billards Game—<www.thespider online. com>, dtd Dec. 2, 2006.

* cited by examiner

*Primary Examiner*—Mitra Aryanpour
(74) *Attorney, Agent, or Firm*—Edward O. Ansell

(57) ABSTRACT

Method and apparatus for conditioning participants in games of billiards or the like to visualize the geometry underlying the pocketing of an object ball as the result of impact by a cue ball through respective employment of a training device. The device adapted to be positioned above the playing surface and out of the field of play, the device consists of support and platform members, said plataform member rotatable in a horizontal plane housing three laser light-emitting means, the first being projected downwardly to illuminate a selected object ball, the second downwardly projecting a line path from the illuminated object ball to the designated target, and the third is directed downwardly to emit a beam projected on the "aim spot," whereby the cue ball is propelled over the "aim spot" impacting the object ball causing the objet ball to travel along the illuminated line path to the designated target.

4 Claims, 2 Drawing Sheets

LASER LIGHT AIMING TRAINER FOR THE GAME OF POOL AND SIMILAR GAMES

CROSS-REFERENCE TO RELATED APPLICATIONS

Applicant claims the priority date of Ser. No. 60/569,542 filed May 10, 2004, the contents of which are incorporated by reference.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

FIELD OF THE INVENTION

The present invention relates to pocket billiards, any one of several games played on an oblong table by driving small balls against one another or into pockets with a cue stick. More specifically, it relates to a method of conditioning players to visualize the geometry underlying the pocketing of an object ball after impact by a cue ball through employment of a training device providing visual cues.

BACKGROUND OF THE INVENTION

The game of pocket billiards, or "pool," has been a popular recreational activity for many years. Many different games have been developed around the game of billiards or "pool." Pool is a game in which one or more players move a plurality of balls about a planar surface on a pool or billiards table in order to either position the balls on the table or "pocket" the balls within one of several "pockets" provided about the periphery of the playing surface of the table.

"Pool" or "billiards" can be played by one or more players. When one person plays "poor" or "billiards" (the two terms will hereinafter be used interchangeably), the person is most often playing to improve his skill at the game. When two players play, they most often compete against one another. In competition, players most commonly compete against one another in order to determine which player is capable of making the most, and most difficult, shots resulting in the pocketing of balls. When "billiards" is played, players generally compete to determine who is most able to position particular balls within specified areas on the table.

Therefore, in order to play pool, billiards, or pocket billiards, a player must accurately position "object" balls on the table by striking the object balls with a single cue ball which is, in turn, struck by the player with a "cue stick." However, beginners sometimes have difficulty learning how to hold the cue stick to produce a desired shot. For example, beginners may succeed in hitting the intended object ball, but the cue ball strikes the object ball at the wrong point, so the object ball is not propelled toward the intended pocket.

Pocketing an object ball in the game of pool involves not merely visualizing an aim line straight from the cue ball to the object ball, but visualizing an aim line from the cue ball to an "aim spot" on the table playing surface, said aim spot being located one cue ball diameter distant from the object ball to be propelled, said "aim spot" being collinear with the line from the object ball to the pocket, and said object ball located between the aim spot and the pocket. This is so the surface of the cue ball strikes the surface of the object ball at a point on the peripheral surface thereof which is aligned with the pocket. Visualizing this geometry during game play can be difficult, and so players sometimes have difficulty learning how to determine the proper aim spot. Once the proper aim spot is determined, it must be visualized by the player. This can also be difficult.

Any device designed to assist pool players in determining the proper aim spot for a shot, and making that aim spot visible for them, would be most useful if it also: (1) did not interfere with the shooter during the shot; (2) did not interfere with the field of play; (3) did not require manipulation of the play balls outside the rules of the game; (4) did not affect the action of the play balls; (5) worked precisely; and (6) could be used quickly and easily.

The prior art contains numerous examples of player training devices, each of which is deficient in some respect as compared to the present invention. By way of example, U.S. Pat. No. 6,117,019 discloses the use of a cue stick mounted laser beam to identify the exact point of contact of the cue ball. U.S. Pat. No. 5,554,075 discloses a cue ball and object ball as well as illuminating the surface of the object ball at that point where the cue ball will strike it. U.S. Pat. No. 5,275,398 discloses an assembly and arrays of light reflectors attached to the table in parallel with ball-rebounding surfaces, said stick assembly including a stick and connected laser unit. For a straight shot the laser beam keeps the cue stick, cue ball, object ball and target pocket aligned. For a bank shot, as the cue ball is struck by the cue stick the laser beam maintains the stick, cue ball, light reflector, object ball and target pocket in alignment. U.S. Pat. No. 4,882,676 discloses a laser generated image directly on the pool table surface to outline a proper path for the cue ball to the object ball. And, Patent Publications 2003/0059752 discloses use of a laser beam generator mounted on the raised railing adjacent a playing surface which generates a beam projected on a point of contact on the peripheral surface of the object ball which, when contacted by the cue ball, will result in the object ball traveling to the designated pocket. However, the means of ascertaining the exact point of contact are not sufficiently disclosed in such full, clear, concise and exact terms to enable any person skilled in the art to which the invention pertains to make and use it.

Accordingly, it is an object of the present invention to provide a method which, by repetition, conditions a player to internalize the process of visualizing the proper alignment to ensure the pocketing of an object ball after impact by a cue ball;

Another object is to provide a system which trains a player to determine the point on the playing surface which must be reached by a cue ball to achieve impact on the periphery of an object ball to ensure pocketing thereof, thereby assisting the player to direct the object ball toward the intended pocket;

A further object is to provide such training apparatus which does not affect the action of the balls in play or interfere with the field of play;

And yet another object of the present invention is to provide a method enhancing the ability of billiard players to visualize aiming principles and thereby increase proficiency in pocketing an object ball;

And yet a further object of the present invention is to provide visual cues to a pool player, or player of a similar game (e.g., billiards, snooker, or the like), teaching the player to visualize aiming principles for himself without use of a training device, thus improving the player's level of skill.

BRIEF SUMMARY OF THE INVENTION

In its broadest aspect, the present invention may be characterized as a method of conditioning players to visualize the geometry underlying the pocketing of an object ball after impact by a cue ball through use of apparatus for identifying an "aim spot," that is, the point on the playing surface of a pocketed pool table, which when reached by a propelled cue ball, will impact a proximate object ball at a point of contact on the peripheral surface thereof assuring the subsequent movement of the impacted object ball into a predesignated pocket. The method employs a training device for the game of billiards and similar games which provides visual cues to lead players toward being able to visualize for themselves where exactly to aim the cue ball. The device comprises a "span" which is positioned above the playing surface and which holds a platform containing three laser lights: one of which is projected downwardly on the object ball, a second that projects the line from the object ball to the pocket, and another which is projected downwardly to indicate the spot the player should aim for, ie., the "aim spot." The platform can be turned to indicate the direction from the object ball to the pocket. The span is held above the playing surface by legs which sit on the sides of the pool table off the playing surface. The device makes certain principles of visualizing pocketing shots visible to a player right on the pool table. Using this visual aid, a player gets used to seeing the proper alignment of aiming elements, leading to internalization of the process, so their play is improved thereafter, i.e., when the device is not employed.

DETAILED DESCRIPTION OF THE INVENTION

Figure 1:
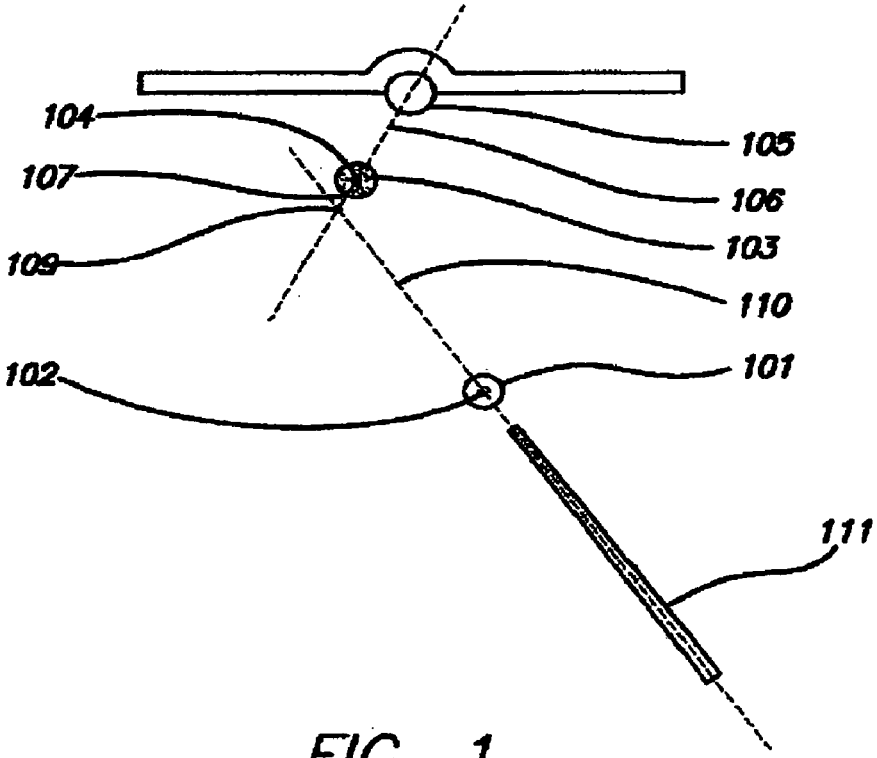
FIG. 1 is a schematic drawing showing the geometry employed in the practice of the method of the present invention.

The present invention makes visible certain geometric properties implicit in aiming correctly in the game of billiards or the like. Referring to FIG. 1, a player uses a cue stick 111 to strike a cue ball 101 so that the cue ball 101 rolls across the playing surface and strikes an object ball 103, knocking the object ball 103 toward a pocket 105. Sometimes the shooter desires to knock an object ball toward the rail or another object ball, but the present invention is primarily designed for those shots where the shooter desires to pocket the object ball, as rail shots and combination shots involve additional visualization issues. In order for the object ball 103 to be knocked toward the pocket 105, the cue ball 101 must strike the object ball 103 at a point of contact 107, on the periphery thereof, which is that end of the diameter of the object ball 103 that is aligned with the direction of desired travel 106. Aiming involves sighting an aim line 110 between the center of the cue ball 101 at its initial position 102 and an aim spot 109, the point on the surface of the table that the cue ball 101 must roll over in order to contact the object ball 103 properly. The aim spot 109 is one play ball diameter (two radii) from the object ball start spot 104 in the direction away from the pocket 105 along the pocket sight line 106, that is, the line from the pocket 105 to the object ball start spot 104.

Figure 2:
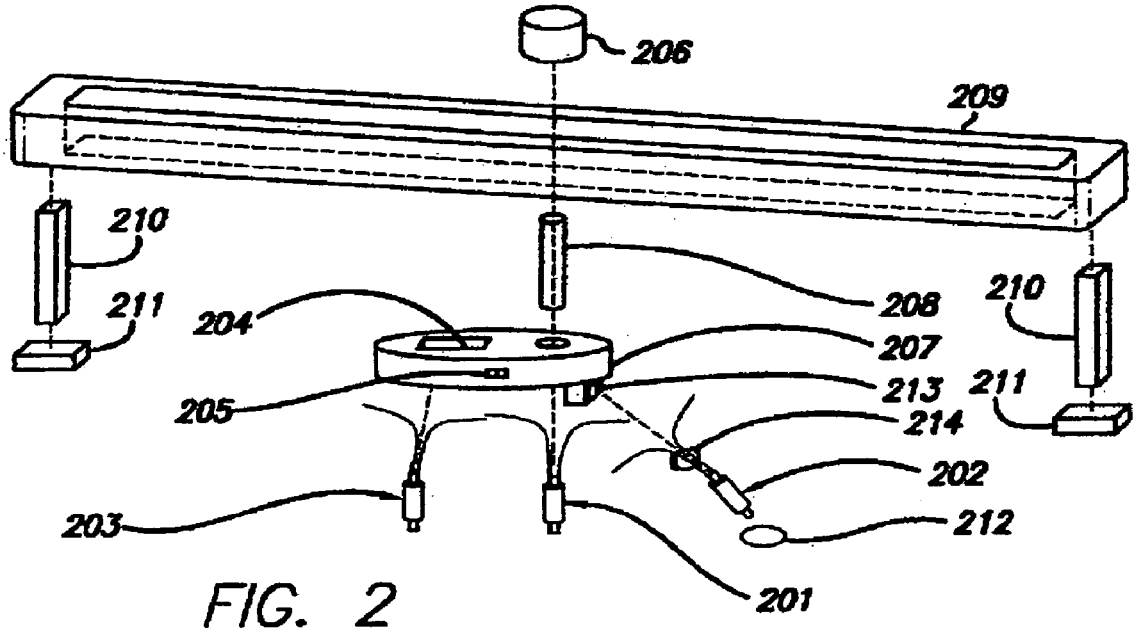
FIG. 2 is an exploded view of the device utilized in practicing the method of the present invention.
Figure 3:
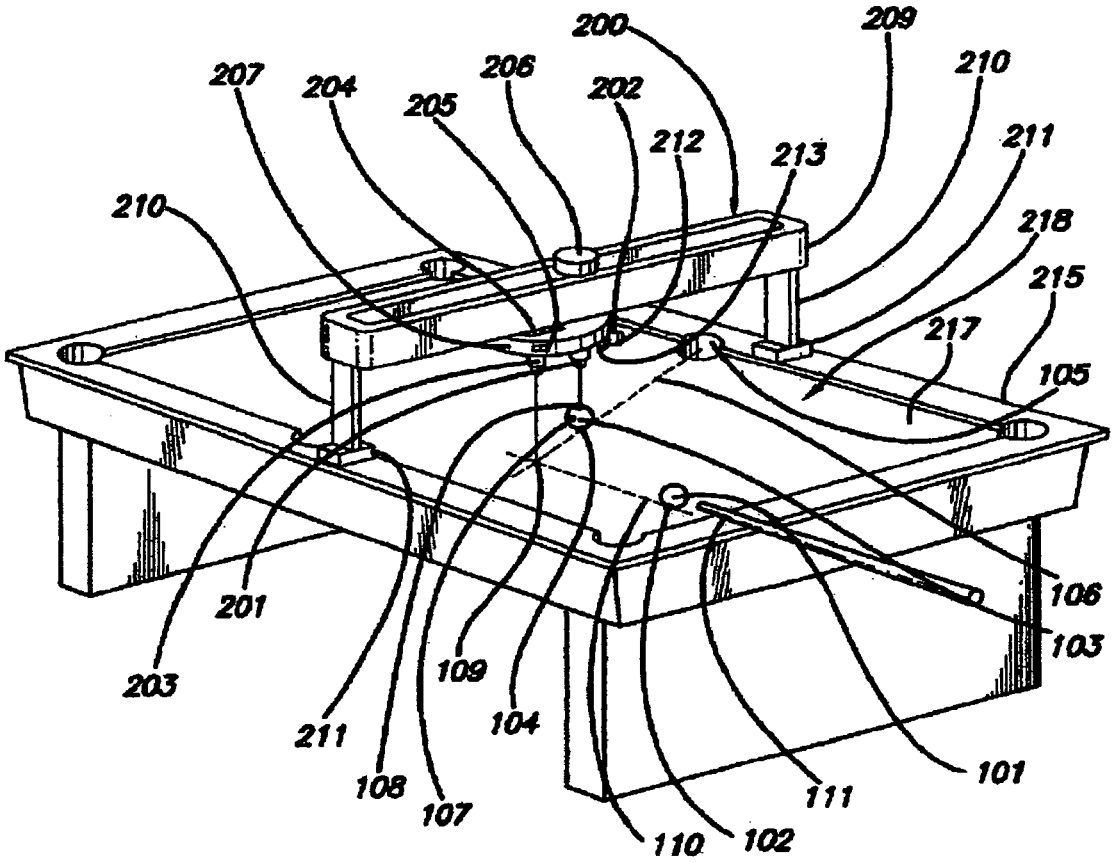
FIG. 3 is a perspective view of the placement of the device of the present invention in relation to a pool table.

Turning to FIGS. 2 and 3, the Laser Light Aiming Trainer, hereafter, the device 200, consists of a laser platform 207 which holds three lasers 201. 202, 203 in proper orientation with each other;, and the supporting structure, made up of the span 209, the legs 210 and the feet 211, which holds the laser platform 207 above a table 215 having a playing surface 217, and out of the field of play 218. and allows for the adjustment of laser platform 207 to the correct position horizontally, and rotationally via knob 206 mounted on rotatable shaft 208. The laser platform 207 hold three laser 201, 202, 203, two of which 201, 202 calibrate the device 200 for the desired shot, and the third 203 which then shows the player the aim spot 109.

The first laser light, the object ball spot laser (OBS laser) 201, projects a spot of light 108 straight down on top of the object ball 103 as seen in FIG. 1 and FIG. 3. The OBS laser 201 is utilized for correctly positioning the device 200. The second laser, pocket sight line laser (PSL laser) 202, employs a line lens 212 to project a line of light, the pocket sight line 106, onto the playing surface 217. The laser platform 207 is rotated, via knob 206 so that the pocket sight line 106 intersects the object ball start spot 104 and the pocket 105. As seen in FIG. 2, the PSL laser 202 is connected at a hinge 213 with a tilt bracket 214 and can be manually tilted up or down to extend or reduce the length of the pocket sight line 106.

When the OBS laser 201 and the PSL laser 202 are properly positioned for the desired shot, the third laser, the aim spot laser 203, indicates the aim spot 109, the point on the surface of the table that the cue ball 101 must roll over in order to contact the object ball 103 properly, thus showing the player exactly where to aim the cue ball 101. The laser platform 207 holds the OBS laser 201 and the aim spot laser 203 perpendicular to the playing surface 217, parallel to each other, and exactly one play ball diameter away from each other. The laser platform 207 holds the PSL laser 202 in line with the OBS laser 201 and the aim spot laser 203.

Appropriate laser diodes are a readily available commodity, typical units requiring approximately 3 volts direct current for energization and having a power consumption of less than 50 milliamperes to produce a power of 3 to 4 milliwatts at a wavelength in the range of 640 to 660 nanometers. Laser line lens 212, sometimes referred to as a "head," comprises a holographical optical element with a straight line pattern held within a common laser diode mounting bracket.

The device 200 can be embodied in several variations without changing the theory of operation. By way of example, different materials can be used in construction. Spans 209 may be of differing lengths (for different width pool tables). A span 209 may be of adjustable length, and span 209 and legs 210 can be made to fold for portability. Except for the electronics and miscellaneous hardware, the device can be made from wood, such as poplar, but can also be made from other materials. In the preferred embodiment, the span 209 is cut to size and then a channel is routed along its length. The feet 211 and legs 210 are attached to the bottom of the span 209 at the ends at right angles using appropriate techniques for the materials being used, such as glue or screws. The laser platform 207 is cut, a hole being drilled through it for the aim spot laser diode 203, and another hole being drilled through for the OBS laser diode 201 and the rotatable shaft 208. A cavity is routed out for the battery box 204, and an adjacent cavity routed out for the power switch 205. Two channels are routed out for wiring from the laser diodes 201, 202 and 203 to the switch 205. Yet another channel is routed out for the wiring to the PSL laser diode 202. The rotatable shaft 208 is attached through the top of the laser platform 207, directly above the OBS laser diode 201 so that turning the laser platform 207 about the shaft 208 leaves the OBS laser 201 pointing down at the same spot. The shaft 208 is fed through a channel in the span 209 from below. The knob 206 is attached to the portion of the shaft 208 that sticks up above the span 209 using appropriate techniques such as glue or screws. The PSL laser diode 202 is inserted into the PSL laser tilt bracket 214 and then attached to the laser platform 207 using PSL laser diode hinge 213 connected with appropriate techniques known to those skilled in the art. The PSL laser diode 202 is vertically adjustable and the pocket sight line 106 remains collinear with the geometric line passing through the object ball start spot 104 and the aim spot 109. Appropriate wiring for the platform 207 connects the PSL laser diode 202, the aim spot laser diode 203, the OBS laser diode 201, the laser power switch 205 and the battery box 204.

Referring to FIG. 3, in use, the laser platform 207 is activated by laser power switch 205. The span 209 is positioned above a pool table 215 and the laser platform 207 is slid along the span 209 so that the OBS laser 201 projects down directly on top of the object ball 103, illuminating spot 104. The laser platform 207 is turned with the knob 206 to indicate the pocket sight line 106, and the aim spot laser 203 aim spot 109 shows where to aim the cue ball 101 in order to knock the object ball 103 to the pocket 105.

In operation, the apparatus 200 is activated and the OBS laser 201 projects an illuminated spot 108 on the top of the selected object ball 103. The laser platform 207 is then rotated so that the pocket sight line 106 emitted by the PSL laser 202 through line lens 212 is projected upon the playing surface 217, running from the object ball start spot 104 and the pocket 105. Since the OBS laser 201 and the aim spot laser 203 are held by the platform 207 perpendicular to the playing surface 217, parallel to each other, and centered a distance exactly one play or object ball diameter from each other, the aim spot laser 203 illuminates the aim spot 109. Having the aim spot 109 thus visually identified, a player may use a cue stick 111 to strike a cue ball 101 so that it rolls across the playing surface 217 and strikes the selected object ball 103 at a point of contact 107, knocking it toward and into a pocket 105 along the illuminated pocket sight line. The process of activating and deactivating the apparatus is repeated until the player is conditioned to visualize the proper alignment of the aiming factors when the apparatus is not employed, thereby leading to the internalization of the process, and enhancement of the skill of the player.

While the present invention has been described with respect to a preferred embodiment thereof, such description is for illustrative purposes only and should not be construed as limiting the scope or breadth of the invention. Various changes and modifications to the described embodiment may be made by those skilled in the art without departing from the true spirit and scope of the invention as defined by the appended claims.

I claim:

1. In games employing a cue ball and a plurality of object balls arranged on a table having a playing surface for deployment in a field of play, a method of enhancing the proficiency of a player by assisting said player to visualize the paths necessary for said cue ball to impact an object ball selected from said plurality of object balls at a point image on the outer periphery of said selected object ball to cause said selected object ball to travel to the intended target, comprising:

(a) positioning a device for production of laser generated emissions upon said table above and outside of said field of play, said device consisting of a support member and a platform member, said support member spanning across the width of the playing surface and said platform member being adjustably received on said support member, said platform member rotatable in a horizontal plane and for housing a first, second and third laser-light emitting means, said first and third laser-light emitting means being oriented parallel to each other in a downward vertical direction, and spaced one object ball diameter apart, said second light-emitting means when energized projecting a line image and being adjustable in orientation;

(b) energizing said first and third laser-light emitting means so that said first laser-light means projects a spot image on the top of said selected object ball whereby said third laser-light emitting means projects a spot image on said playing surface spaced a horizontal distance of one object ball diameter from said spot image on the top of said selected object ball in a direction opposite the location of the intended targets, said support member and platform member being positioned so that said first laser-light emitting means, when energized, projects a spot image on the top of said selected object ball;

(c) energizing said second laser-light emitting device; and (d) rotating said platform member so that emission from said second laser-light emitting means projects a line image intersecting said spot image on the top of said selected object ball and said target, whereby the illuminated spot image on the playing surface defines the spot that a cue ball must traverse to impact said selected object ball to travel along said line image to reach its intended target.

2. The method of claim 1 wherein the playing surface is the surface of a pool table and the intended target is a pocket arranged at the periphery of said playing surface adapted to receive an object ball therein.

3. An apparatus for enhancing the proficiency of a player in games employing a cue ball and a plurality of object balls arranged on a table having a playing surface for deployment in a field of play, by assisting said player to visualize the paths necessary for said cue ball to impact an object ball selected from said plurality of object balls at a point image on the outer periphery of said selected object ball, to cause said selected object ball to travel to intended target, comprising:

(a) means for positioning a device for production of laser generated emissions upon said table above and outside of said field of play said means including a support member and a platform member, said support member spanning across the width of the playing surface and said platform member being adjustably received on said support member;

(b) a first, second and third laser-light means, said first and third laser-light means being positioned to downwardly emit spot images, said first and third laser-light means being oriented parallel to each other in a downward vertical direction and separated a distance of one object ball diameter apart;

(c) means for positioning said rotatable platform member so that emission from said first laser-light means projects a spot image at the top of said selected object ball, said second light-emitting means being adjustable in orientation and projecting a line image upon said table surface from said spot image at the top of said selected object ball to the intended target, and emission from said third-laser-light means projecting a spot image on said table playing surface one object ball diameter distant from said spot on the top of said selected object ball in a direction opposite the line image projected between the spot image on the top of said selected object ball and the intended target, thereby illuminating the spot image on said playing surface that said cue ball must traverse to impact said selected object ball to travel along the line image projected by said second laser-light means to reach the intended target.

4. An apparatus as set forth in claim 3 and in addition, a laser line lens associated with said second laser light emitting means by which said line path is generated.

* * * * *